US005304447A

United States Patent [19]

Svendsen et al.

[11] Patent Number: 5,304,447

[45] Date of Patent: Apr. 19, 1994

[54] PLATEABLE TONER AND METHOD FOR PRODUCING THE SAME

[75] Inventors: Leo G. Svendsen, Redwood City; Geoffrey J. Holland, Danville, both of Calif.

[73] Assignee: ELF Technologies, Inc., Foster City, Calif.

[21] Appl. No.: 834,055

[22] Filed: Feb. 11, 1992

[51] Int. Cl.[5] ..... G03G 9/093

[52] U.S. Cl. ..... 430/109; 430/137; 430/138; 428/402.24

[58] Field of Search ..... 430/109, 137, 138; 428/402.24

[56] References Cited

U.S. PATENT DOCUMENTS

| | | | |
|---|---|---|---|
| 3,880,689 | 4/1975 | Rolker et al. | 156/233 |
| 4,020,009 | 4/1977 | Gulla | 427/98 |
| 4,048,354 | 9/1977 | Feldstein | 427/304 |
| 4,327,125 | 4/1982 | Feldstein | 427/304 |
| 4,421,660 | 12/1983 | Solc nee Hajna | 252/62.54 |
| 4,465,755 | 8/1984 | Kiritani et al. | 430/138 X |
| 4,495,216 | 1/1985 | Sorensen et al. | 427/25 |
| 4,504,529 | 3/1985 | Sorensen et al. | 427/437 |
| 4,518,738 | 5/1985 | Sorensen et al. | 524/435 |
| 5,135,832 | 8/1992 | Sacripante et al. | 430/138 X |

FOREIGN PATENT DOCUMENTS

| | | |
|---|---|---|
| 0049882 | 4/1982 | European Pat. Off. . |
| 087135 | 8/1983 | European Pat. Off. . |
| 1521442 | 10/1969 | Fed. Rep. of Germany . |
| 2207425 | 8/1973 | Fed. Rep. of Germany . |

*Primary Examiner*—Roland Martin

*Attorney, Agent, or Firm*—Burns, Doane, Swecker & Mathis

[57] ABSTRACT

A plateable toner which can be effectively employed in plateable toner technology comprises a shell and core arrangement where the core is a toner particle and the shell is an effective amount of at least one catalyzing and/or activating compound for electroless plating and at least one binding and/or sensitizing compound. The toner core can comprise a commercially available OEM toner powder, a toner core having properties selected for PTT produced by techniques employed in OEM toner production or a spray dried toner core.

29 Claims, No Drawings

PLATEABLE TONER AND METHOD FOR PRODUCING THE SAME

BACKGROUND OF THE INVENTION

The present invention relates to a toner for use in plateable toner processes and in particular electroless metal plating as well as a method for producing the toner.

Plateable toner technology (PTT) relates to a localized metallization of a surface and in particular a polymeric surface by, e.g., xerographic or laser printing of a pattern followed by plating the pattern to the desired conductivity. See for example, Sorensen et al U.S. Pat. No. 4,504,529 which is incorporated herein by reference.

PTT employs the use of a "plateable" toner which has been formed by a single stage, spray drying process in which the particles have been imparted with the desired sensitizing and catalytic/activating properties. Suitable toners are discussed, for example, in Sorensen et al U.S. Pat. Nos. 4,495,216, Sorensen et al U.S. Pat. No. 4,518,738, and European Patent 0087135 to Sorensen et al, which patents are also incorporated by reference.

Despite the effectiveness of these toners in PTT processes, they also suffers from certain drawbacks. For example, it is desirable that the sensitizing compound be a tin salt. However, because these tin salts are heat sensitive, a spray drying process is employed in making these toners.

Furthermore, the use of spray drying in the production of toners produces a substantially spherical particle as compared to the generally "jagged" or irregular shape of toners produced by more conventional methods. These spherical shapes are not easily transferred in current electrophotographic equipment, e.g., printers, which are in fact optimized for the more traditional "jagged" shapes, and thus are not preferred in such environments.

The use of spray drying also limited the number of polymers which may be employed. For example, although an organic solution of a polymer is capable of being employed in a spray drying process, the environmental problems associated with the use of such organic solutions makes such processes impractical and uneconomical. Thus, the polymers which may be practically employed in spray drying processes are those which may be employed as a water-based latex.

Thus, the need clearly exists for a toner which is capable of overcoming these limitations of existing toners.

SUMMARY OF THE INVENTION

The present invention relates to a method for producing a plateable toner which can be effectively employed within plateable toner technology. In particular, the present invention relates to a shell and core arrangement where the core is a toner particle and the shell is an effective amount of at least one catalyzing and/or activating compound for electroless plating and at least one binding and/or sensitizing compound for the catalyzing and/or activating compound. In one aspect, the present invention relates to a method comprising providing a plurality of toner particles and applying a effective amount of the shell onto each particle. Moreover, the toner "core" employed in the present invention can be produced in a number of ways.

Among other aspects, the present invention is based upon the surprising discovery that toner cores which are produced by methods other than spray drying may be employed in PTT technology. Thus, the toner core can comprise a commercially available OEM toner powder, for example, those toners employed in laser printers.

In another aspect, the present invention relates to a method of making a plateable toner core by techniques that are traditionally employed in OEM toner production. Furthermore, this aspect of the invention also includes providing a toner core having properties selected for PTT. This can involve the use of certain polymeric materials as well as the inclusion of certain crosslinking agents.

In yet another aspect, the toner core can be an aqueous slurry comprising a polymeric emulsion, a finely divided magnetic emulsion and a compatibilizing surfactant which slurry is spray dried to form the cores.

In each of the above aspects, the shell preferably comprises an aqueous suspension of at least one sensitizing and/or binding compound, at least one catalyzing and/or activating compound, and optionally at least one surfactant. This suspension is preferably applied to the core by a spray drying process.

The present invention also relates to shell and core toners produced by the above methods.

DETAILED DESCRIPTION OF THE PREFERRED EMBODIMENTS

The present invention relates to a "shell and core" arrangement for plateable toners. The "core" of this plateable toner can be produced by any of numerous techniques.

In particular, one aspect of the present invention relates to the use of conventional original equipment manufacture (OEM) toners in the production of plateable toners. These OEM toners include those employed in, e.g., laser printers, and are commercially available from a variety of sources such as Ricoh, Canon, Panasonic, Xerox, Minolta, Konica, Toshiba, Sharp, Kodak, 3M, Fuji, Nashua, and ICMI, to name a few.

Specific examples of suitable toners for use as the core include toners obtained from 92295A Toner Cartridge from Canon, Toner Kit 80/150 Model 5397-26 by Ricoh, Panasonic SuperMagnefine (TM) No. FQ-TA10 from Matsushita Electrical Industrial Co., and Xerox Black Toner Cartridge 8840 No. 6R349.

The present invention also relates to a method for the production of plateable toners which have superior properties and which can be produced by those techniques commonly employed in the production of, e.g., OEM toners.

For example, it is desirable to provide a core having the following chemical and/or physical properties:

(1) that the toner be electrophotographically, electrostatically, magnetically, and/or magnetostatically transferrable. For example, it is desirable that the toner be free flowing so that it can be transferred in, e.g., a laser printer;

(2) that it has a high adhesive strength to a variety of substrates such as epoxies, polyimides and polyesters;

(3) that it does not "interfere" with the catalytic shell, e.g., that it does not deteriorate, caused the deterioration of or block the activity of, e.g., iron, $Fe^{2+}$, $Fe^{3+}$, $Sn^{2+}$, $Sn^{4+}$, palladium or $Pd^{2+}$;

(4) that it is plateable, i.e., that it can withstand attack from the chemicals employed in plating solutions which can include either basic or acidic components. For example, it is preferred that the core withstand a pH of 13 at a temperature of 80° C. for as long as 12 hours and also withstand a pH of 1 at 40° C. for as long as 12 hours;

(5) that it is solderable, i.e., that it does not deteriorate when in contact with solder and also that it can withstand the heat of soldering, e.g., 550° C. for 10 sec, which occurs subsequent to plating; and (6) that it is capable of being effectively employed in the desired environment, i.e., it is capable of both producing a product while also increasing the quality of the product. For example, when employed in conventional laser printers, it preferably has a melting point of about 90°-110° C. and may be subsequently crosslinked. In order to increase the quality of the final product, it is desired that the core be tough and flexible.

Any polymer capable of providing one or more of the above described properties can be effectively employed in producing the core. Certain polymers such as epoxies, polyesters including polyvinyl esters, furan resins and phenolic resins are preferred because they can effectively combine those desired chemical and physical properties associated with processing with the desired attributes of the final product. Specific examples of suitable polymers include epoxy resins such as Araldite ECN 1299 from Ciba-Geigy Corp. and EPON Resin 2002 from Shell Chemical Co.

In order to achieve the above objectives, it is also preferred that a crosslinking agent be introduced into the polymer system. Preferably, this crosslinking agent is selected such that the polymer system will go from a thermoplastic polymer to a crosslinked polymer after passing through a curing cycle, e.g., where suitable radiation, e.g., heat, infrared, UV and microwave radiation, is applied to the polymer.

Suitable crosslinking agents include heterocyclic amines and cyanoamines with specific examples including cyanoguanidine and EPON Curing Agent P-101 from Shell Chemical Co.

As discussed previously, these preferred toner cores can be produced by methods such as those continuous and batch processes traditionally employed in the production of OEM toners. Thus, they need not be described in detail here.

However, such methods typically involve the melt blending of the polymer, coloring agents, magnetic materials such a magnetite, crosslinking agents, and other components at a temperature sufficient to produce a polymer system having the consistency of, e.g., a viscous paste. Subsequent to melt blending, the mixture is cooled and then ground into a fine powder which is classified and the appropriately sized particles being employed as the toner. For use in conventional laser printers, a size of about 10 microns is preferred. However, it is apparent that the size is dependent on the end use.

In yet another aspect of the present invention, the toner core can be produced by a spray drying process. In such a process, a finely divided magnetic emulsion such as Bayferrox B8610 from Bayer Verdingen, a polymeric emulsion, e.g., a polystyrene emulsion or an acrylic emulsion such as Neocryl emulsion from ICI Resins, and a compatibilizing surfactant such as Additol from Hoechst AS are combined to form an aqueous slurry. This slurry is then spray dried to produce the core particles.

The present invention also relates to the application of a shell or coating onto the above described toner cores. In particular, this shell or coating comprises at least one catalyzing and/or activating compound for electroless plating and at least one binding and/or sensitizing compound for the catalyst or activating compound. Suitable compounds are recognized in the art, e.g., the previously discussed Sorensen patents. More preferred catalyzing and/or activating compounds include $PdCl_2$, $PtCl_4 5H_2O$ and $AuCl_3$ while more preferred binding and/or sensitizing compounds include compounds such as $SnCl_2 2H_2O$, $MgCl_2 6H_2O$, $CaCl_2 6H_2O$ and $AlCl_3 6H_2O$.

The shell is preferably produced in the form of an aqueous suspension comprising at least one sensitizing and/or binding compound, at least one catalyzing and/or activating compounds and, optionally, at least one surfactant.

These surfactants are effective in both stabilizing the aqueous suspension of toner core and shell mixture during spray drying and enhancing the contact angle between the catalytic sites and, e.g., copper solution during manufacture of copper coated toner traces. Suitable surfactants include, for example, nonionic surfactants which do not interfere with the plating solutions. Specific examples of such surfactants include Atlas G 3300 B from ICI Specialty Chemicals, Fluorad FC-99 from 3M Industrial Chemical Products Division, and Lica 44 from Kenrich Chemicals.

Moreover, this shell can be applied by techniques recognized in the art in which the shell suspension will effectively form a coating around the individual toner cores. Suitable techniques include microencapsulation techniques, fluidized bed techniques, or spray drying techniques. Although the spray drying from aqueous slurries of toner core and shell suspension is preferred.

Spray drying, as discussed throughout this specification, can be performed by those means which are recognized in the art. Accordingly, they need not be described in detail here. For example, suitable conditions include:

| | |
|---|---|
| Feed Rate of Suspension: | 100-300 ml/min |
| Air inlet temperature: | 130-200° C. |
| Air outlet temperature: | 50-100° C. |
| Stirring speed: | 4-500 rpm |
| Air intake to drying chamber: | 200-600 kg/hr |
| Atomizer speed: | 15,000-25,000 rpm |
| Air quality: | Filtered room air or nitrogen |

The following Examples illustrate certain aspects of the present invention and are understood to be illustrative and nowise limitive.

EXAMPLES

Example 1

600 grams of toner is collected from the toner cartridges in Toner Kit 80/150 model no. 5397-26 (approximately 3 cartridge-fulls). The toner is stirred into the following catalytic mixture:

4000 grams of distilled water
30 grams of Atlas G 3300 solution (3%)
9grams of $SnCl_2 \cdot 2H_2O$
15 grams of Neocryl suspension (40%)
3grams of $PdCl_2$ 5grams of $MgCl_2 \cdot 6H_2O$ Vigorous mechanical stirring breaks up toner agglomerates and prevents the slurry from precipitating before spray drying.

Spray drying is carried out under the following conditions:

| | |
|---|---|
| Feed rate of suspension: | 150 ml/min |
| Air inlet temperature | 170° C. |
| Air outlet temperature | 70° C. |
| Stirring speed | 500 rpm |
| Air intake to drying chamber | 400 kilograms/hour |
| Atomizer speed | 20,000 rpm |
| Air quality | Filtered room air |

After preparation the plateable toner is sifted through a 270 mesh (53 micrometer) 8 inch diameter screen to remove coarse particulates, e.g., agglomerates. This toner will be applicable to any laser printer using Toner Kit 80/150 model no. 5397-26 such as OCT 810 which has a Ricoh 4081 laser engine creating the patterns.

EXAMPLE 2

1000 grams of toner is collected from a Xerox Black Toner Cartridge 8840 no. 6R349 (approximately the content of one cartridge). The toner is stirred into the following catalytic mixture:

| | |
|---|---|
| 7000 | grams of distilled water |
| 1 | gram of Lica 44 |
| 10 | grams of $SnCl_2.2H_2O$ |
| 12.5 | grams of Neocryl suspension (40%) |
| 2.5 | grams of $PdCl_2$ |

Vigorous mechanical stirring breaks up toner agglomerates and prevents the slurry from precipitating before spray drying.

Spray drying is carried out under the following conditions:

| | |
|---|---|
| Feed rate of suspension: | 200 ml/min |
| Air inlet temperature | 180° C. |
| Air outlet temperature | 73° C. |
| Stirring speed | 500 rpm |
| Air intake to drying chamber | 400 kilograms/hour |
| Atomizer speed | 17,000 rpm |
| Air quality | Filtered room air |

After preparation the plateable toner is sifted through a 200 mesh (75 micrometer) 8 inch diameter screen to remove coarse particulates. This toner will be applicable to any laser printer using Xerox Black Toner Cartridge 8840 no. 6R349 such as the 8840D laser plotter from Fuji-Xerox.

EXAMPLE 3

1200 grams of toner is produced from the following raw material:

| | |
|---|---|
| 600 | grams of magnetite powder (<.5 μm. particle size) |
| 600 | grams of epoxy resin "Araldite ECN 1299" from Ciba-Geigy Corp. |

The mixture is compounded at 60° C. for 3 hours on a 3×8 inch two roll mill. After compounding, the material is crushed and jet milled to an average particle size of 12 micrometers, and finally classified to take out fines, i.e., particles below 5 micrometers in diameter, and coarse materials above 20 micrometers in diameter.

The 1200 grams of produced toner is stirred into the following catalytic mixture:

| | |
|---|---|
| 8000 | grams of distilled water |
| 60 | grams of Atlas G 3300 solution (3%) |
| 18 | grams of $SnCl_2.2H_2O$ |
| 30 | grams of Neocryl suspension (40%) |
| 6 | grams of $PdCl_2$ |
| 9 | grams of $MgCl_2.6H_2O$ |
| 60 | grams of Amicure CG-1299 Curing Agent from Pacific Ancor Chemical Corporation |

Vigorous mechanical stirring breaks up toner agglomerates and prevents the slurry from precipitating before spray drying.

Spray drying is carried out under the following conditions:

| | |
|---|---|
| Feed rate of suspension: | 140 ml/min |
| Air inlet temperature | 160° C. |
| Air outlet temperature | 70° C. |
| Stirring speed | 500 rpm |
| Air intake to drying chamber | 400 kilograms/hour |
| Atomizer speed | 22,000 rpm |
| Air quality | Filtered room air |

After preparation the plateable toner is sifted through a 325 mesh (45 micrometer) 8 inch diameter screen to remove coarse particulates. This toner is applicable to any laser printer using a Ricoh 4081 laser engine or similar type for creating the patterns.

EXAMPLE 4

1500 grams of toner is produced from the following raw material:

| | |
|---|---|
| 500 | grams of magnetite powder (<.5 μm. particle size) |
| 1000 | grams of epoxy resin EPON ® Resin 2002 from Shell Chemical Company |

The mixture is compounded at 120° C. for 3 hours on a 3×12 inch two roll mill.

| | |
|---|---|
| 30 | grams of EPON ® Curing Agent P-101 from Shell Chemical Company |

is now added from the compound and the compounding continues for 20 minutes until the curing agent is mixed into the toner core material. The compounding temperature is lowered to 100° C. to avoid excessive cross linking in the toner. After compounding, the material is crushed and jet milled to an average particle size of 10 micrometers, and finally classified to take out fines, i.e., particles below 5 micrometers in diameter, and coarse materials above 20 micrometers in diameter.

The 1500 grams of produced toner is stirred into the following catalytic mixture:

| | |
|---|---|
| 10,000 | grams of distilled water |
| 2.2 | grams of Fluorad FC-99 (25%) |
| 7.5 | grams of $PdCl_2$ |
| 12 | grams of $MgCl_2.6H_2O$ |

Vigorous mechanical stirring breaks up toner agglomerates and prevents the slurry from precipitating before spray drying.

Spray drying is carried out under the following conditions:

| | |
|---|---|
| Feed rate of suspension: | 220 ml/min |
| Air inlet temperature | 190° C. |
| Air outlet temperature | 85° C. |
| Stirring speed | 500 rpm |
| Air intake to drying chamber | 400 kilograms/hour |
| Atomizer speed | 16,000 rpm |
| Air quality | Filtered room air |

After preparation the plateable toner is sifted through a 270 mesh (53 micrometer) 8 inch diameter screen to remove coarse particulates. This toner is applicable to a Fuji-Xerox laser Plotter or similar type for creating patterns.

While the invention is described in terms of various preferred embodiments, the artisan will appreciate the various modifications, substitutions, omissions and changes may be made without departing from the spirit thereof. Accordingly, it is intended that the scope of the present invention be limited solely by the scope of the following claims including equivalents thereof:

What is claimed is:

1. A method for making a plateable toner particle comprising:

providing a toner core having a size of 5–20 $\mu$ and comprising at least one polymer selected to enhance a chemical or physical property of a plateable toner;

applying an effective amount of a shell onto the core from a solution which comprises at least one binding compound, at least one catalyzing and/or activating compound for electroless plating and a surfactant for enhancing the contact angle between the catalyzing and/or activating compound and an electroless plating solution, wherein the toner core is devoid of catalyzing and/or activating compounds, sensitizing compounds and the surfactant.

2. The method according to claim 1 wherein the shell is applied by a spray drying process.

3. The method according to claim 1 wherein the toner core has a generally irregular shape.

4. The method according to claim 3 wherein the polymer is selected from the group consisting of epoxies, polyesters, furan resins and phenolic resins.

5. The method according to claim 4 wherein the toner core further comprises at least one crosslinking agent.

6. The method according to claim 5 wherein the crosslinking agent is selected such that the polymer will go from a thermoplastic polymer to a crosslinked polymer upon exposure to an effective amount of electromagnetic radiation.

7. The method according to claim 6 wherein the crosslinking agent is selected from the group consisting of heterocyclic amines and cyanoamines.

8. The method according to claim 7 wherein the toner core further comprises at least one coloring agent or magnetic material.

9. The method according to claim 5 wherein the toner core is produced by melt blending the components so as to form a mixture, cooling the mixture, and grinding the cooled mixture.

10. The method according to claim 9 wherein the core are ground to about 10 microns in diameter.

11. The method according to claim 5 wherein the solution further comprises at least one sensitizing compound.

12. The method according to claim 11 wherein the at least one catalyzing and/or activating compound is selected from the group consisting of $PdCl_2$, $PtCl_4 5H_2O$, and $AuCl_3$, the at least one sensitizing compound is $SnCl_2 2H_2O$ and the at least one binding compound is $MgCl_2 6H_2O$.

13. The product produced by the process of claim 1.

14. The product produced by the process of claim 7.

15. A shell and core plateable toner in which the shell comprises at least one binding compound, at least one catalyzing and/or activating compound for electroless plating, and at least one surfactant for enhancing the contact angle between the catalyzing and/or activating compound and an electroless plating solution and the core is an untreated original equipment manufacture (OEM) toner.

16. The toner according to claim 15 wherein the OEM toner is selected from the group consisting of those toners employed with laser printers.

17. A shell and core plateable toner in which the shell comprises at least one binding compound, at least one catalyzing and/or activating compound for electroless plating, and at least one surfactant for enhancing the contact angle between the catalyzing and/or activating compound and an electroless plating solution and the core comprises at least one polymer selected to enhance a chemical or physical property of a plateable toner and, optionally, at least one crosslinking agent and is devoid of catalyzing and/or activating compounds, sensitizing compounds, and the at least one surfactant.

18. The toner according to claim 17 wherein the polymer is selected from the group consisting of epoxys, polyesters, furan resins, and phenolic resins.

19. The toner according to claim 18 wherein the crosslinking agent is selected such that the polymer will go from a thermoplastic polymer to a crosslinked polymer upon exposure to an effective map of electromagnetic radiation.

20. The toner according to claim 19 wherein the crosslinking agent is selected from the group consisting of cyanoamines and heterocyclic amines.

21. The toner according to claim 27 wherein the at least one catalyzing and/or activating compound is selected from the group consisting of $PdCl_2$, $PtCl_4 5H_2O$, and $AuCl_3$, the at least one sensitizing compound is $SnCl_2 2H_2O$ and the at least one binding compound is $MgCl_2 6H_2O$.

22. A method for making a plateable toner particle comprising providing an untreated original equipment manufacture (OEM) toner particle;

applying an effective amount of the shell onto the particle from a solution which comprises at least one binding compound, at least one catalyzing and/or activating compound for electroless plating and at least one surfactant for enhancing the contact angle between the catalyzing and/or activating compound and an electroless plating solution.

23. The product produced by the process of claim 22.

24. The method according to claim 22 wherein the OEM toner particle is selected from the group consisting of those toners employed in laser printers.

25. The method according to claim 24 wherein the solution further comprises at least one sensitizing compound.

26. The method according to claim 25 wherein the at least one catalyzing and/or activating compound is selected from the group consisting of $PdCl_2$, $PtCl_45H_2O$, and $AuCl_3$, the at least one sensitizing compound is $SnCl_22H_2O$ and the at least one binding compound is $MgCl_26H_2O$.

27. The toner according to claim 15, wherein the shell further comprises at least one sensitizing compound.

28. The toner according to claim 20, wherein the shell further comprises at least one sensitizing compound.

29. The toner according to claim 28 wherein the at least one catalyzing and/or activating compound is selected from the group consisting of $PdCl_2$, $PtCl_45H_2O$, and $AuCl_3$, the at least one sensitizing compound is $SnCl_22H_2O$ and the at least one binding compound is $MgCl_26H_2O$.

* * * * *